US011008668B2

(12) United States Patent
Tomita

(10) Patent No.: US 11,008,668 B2
(45) Date of Patent: May 18, 2021

(54) INSPECTION METHOD, INSPECTION DEVICE, AND PLATING APPARATUS INCLUDING THE SAME

(71) Applicant: EBARA CORPORATION, Tokyo (JP)

(72) Inventor: Masaki Tomita, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 51 days.

(21) Appl. No.: 16/391,717

(22) Filed: Apr. 23, 2019

(65) Prior Publication Data

US 2019/0330758 A1 Oct. 31, 2019

(30) Foreign Application Priority Data

Apr. 27, 2018 (JP) ..... JP2018-086597

(51) Int. Cl.
*C25D 17/00* (2006.01)

(52) U.S. Cl.
CPC ..... *C25D 17/001* (2013.01); *C25D 17/004* (2013.01); *C25D 17/005* (2013.01)

(58) Field of Classification Search
CPC ..... C25D 17/001; C25D 21/12; C25D 7/12; C25D 7/123; H01L 21/68721; H01L 21/68764; H01L 21/68707; H01L 21/6715; H01L 21/67781; H01L 21/68; H01L 21/68714; H01L 21/682; H01L 24/83; H01L 21/6833; H01L 21/67178; H01L 21/76879; H01L 24/11; H01L 2224/05573; H01L 2224/94; H01L 22/12; H01L 21/67161; H01L 24/80; Y10S 414/136; Y10S 414/135; Y10S 414/138; G05B 2219/45031; G01N 21/9501; G01N 23/225; G01N 23/2251; H01J 2237/2441; H01J 2237/2446; H01J 2237/2817; H01J 37/20; H01J 2237/082; H01J 2237/202; H01J 2237/24564; H01J 2237/2806;
(Continued)

(56) References Cited

U.S. PATENT DOCUMENTS 5,980,195 A * 11/1999 Miyashita ..... H01L 21/6732 414/783
6,052,913 A * 4/2000 Kaneko ..... H01L 21/68 33/645

(Continued)

FOREIGN PATENT DOCUMENTS

JP 2013-083242 A 5/2013

*Primary Examiner* — Santiago Garcia
(74) *Attorney, Agent, or Firm* — Rothwell, Figg, Ernst & Manbeck, P.C.

(57) ABSTRACT

There is provided an inspection method of a substrate holder for holding a substrate. This inspection method has a step of providing the substrate holder comprising a first member and a second member between which a substrate is held, an electric contact, and a seal member, the first member having a surface region where intrusion of the liquid is prevented by the seal member, the second member having the seal member, a step of holding the second member by a holding portion of a substrate holder opening/closing unit, and detaching the second member from the first member, and a detection step of detecting that the liquid adheres to the surface region of the first member, by a detector located above the first member and the second member.

15 Claims, 7 Drawing Sheets

(58) Field of Classification Search
CPC ..... H01J 37/073; H01J 37/222; G03F 7/2022; G03F 7/7065; G03F 7/2028; G03F 7/3021
USPC ..... 382/145; 414/783, 936, 941; 205/157
See application file for complete search history.

(56) References Cited

U.S. PATENT DOCUMENTS 6,091,498 A * 7/2000 Hanson ..... H01L 21/67173 356/623
7,138,629 B2 * 11/2006 Noji ..... G01N 23/225 250/311
2002/0006876 A1 * 1/2002 Hongo ..... H01L 21/6719 156/345.12
2002/0009357 A1 * 1/2002 Hanson ..... H01L 21/67769 414/639
2002/0009658 A1 * 1/2002 Sato ..... H01L 21/67178 430/30
2002/0063097 A1 * 5/2002 Fukunaga ..... C25D 17/001 210/656
2002/0131848 A1 * 9/2002 Kurata ..... H01L 21/67288 414/217
2002/0148961 A1 * 10/2002 Nakasuji ..... H01J 37/222 250/311
2003/0185655 A1 * 10/2003 Uchimaki ..... H01L 21/67736 414/217
2005/0014368 A1 * 1/2005 Yoshioka ..... C25D 17/08 438/689
2005/0221208 A1 * 10/2005 Murakami ..... G03F 7/40 430/30
2012/0218455 A1 * 8/2012 Imai ..... G02B 13/0085 348/340
2012/0307233 A1 * 12/2012 Boguslavskiy ..... G01N 21/71 356/43
2014/0318977 A1 10/2014 Moore et al.
2016/0240401 A1 * 8/2016 Muramoto ..... H01L 21/6715
2016/0319456 A1 * 11/2016 Yoshioka ..... C25D 21/12

* cited by examiner

INSPECTION METHOD, INSPECTION DEVICE, AND PLATING APPARATUS INCLUDING THE SAME

TECHNICAL FIELD

CROSS-REFERENCE TO RELATED APPLICATION

This application is based upon and claims benefit of priority from Japanese Patent Application No. 2018-086597 filed on Apr. 27, 2018, the entire contents of which are incorporated herein by reference.

The present invention relates to an inspection method, an inspection device, and a plating apparatus including this device.

BACKGROUND ART

Heretofore, an apparatus has been known in which a substrate held by a substrate holder is inserted along a vertical direction into a plating bath containing a plating solution, to perform electroplating (e.g., see PTL 1). Another apparatus is also known in which a substrate held by a substrate holder is oriented in a horizontal direction and subjected to electroplating (e.g., see PTL 2). In the substrate holder for use in such a plating apparatus, a surface of the substrate is sealed, to form a space into which the plating solution does not penetrate. In this space, the substrate holder has an electric contact that comes in contact with the surface of the substrate, thereby causing a current to flow through the substrate.

Such a substrate holder plays a very important role in a plating process. Specifically, the electric contact of the substrate holder appropriately comes in contact with the surface of the substrate, so that the current can appropriately flow through the substrate. Consequently, a uniform plating film can be formed on the substrate. Furthermore, in the substrate holder, the surface of the substrate is appropriately sealed, to prevent the plating solution from penetrating the above space. Thus, the electric contact comes in contact with the plating solution, to inhibit corrosion of the electric contact, local change of the current that flows through the substrate, and the like. In other words, for example, if breakage or corrosion occurs at the electric contact, the current cannot appropriately flow through the substrate. Furthermore, when the plating solution penetrates the above space, the current flowing through a portion where the plating solution is present is different from the current flowing through another portion in the substrate. Therefore, uniformity of the plating film to be formed on the substrate deteriorates. For example, if an abnormality is generated in a sealing portion of the substrate holder, the plating solution penetrates the above space. Consequently, inspecting whether or not any abnormality is generated in the substrate holder is an important operation to continue an appropriate plating process.

CITATION LIST

Patent Literature

PTL 1: Japanese Patent Laid-Open No. 2013-83242

PTL 2: U.S. Patent No. 2014/0318977

SUMMARY OF INVENTION

Technical Problem

It has been confirmed whether or not a liquid such as a plating solution or a cleaning solution penetrates a space of a substrate holder as described above, when a plated substrate is removed from the substrate holder. Specifically, when the substrate holder is opened in a device that opens and closes the substrate holder, the liquid flows out from the above space. This liquid is captured in a drain pan, and this liquid is detected with a liquid sensor provided on a downstream side of the drain pan.

However, there is a problem that, when the liquid is detected with such a configuration, a small amount of liquid is hard to detect. Specifically, when the amount of the liquid is small, even the liquid flowing through the drain pan toward the downstream side cannot reach the liquid sensor. In this case, although the liquid intrudes into the above space, it cannot be detected that an abnormality is generated in the substrate holder.

The present invention has been developed in view of the above described problem, and one of objects of the present invention is to provide an inspection device of a substrate holder which is capable of also detecting a small amount of liquid.

Solution to Problem

According to one aspect of the present invention, there is provided an inspection method of a substrate holder having a first member and a second member between which a substrate is held, an electric contact configured to come in contact with a surface of the substrate to be treated, and a seal member configured to come in contact with the surface of the substrate to be treated so that a liquid does not come in contact with the electric contact, the first member having a surface region where intrusion of the liquid is prevented by the seal member, the second member having the seal member. This inspection method has a step of holding the second member by a holding portion of a substrate holder opening/closing unit, and detaching the second member from the first member, and a detection step of detecting that the liquid adheres to the surface region of the first member, by a detector located above the first member and the second member.

According to another aspect of the present invention, there is provided an inspection device of a substrate holder having a first member and a second member between which a substrate is held, an electric contact configured to come in contact with a surface of the substrate to be treated, a seal member configured to come in contact with the surface of the substrate to be treated so that a liquid does not come in contact with the electric contact, and a surface region where intrusion of the liquid is prevented by the seal member, the second member having the seal member. This inspection device has a substrate holder opening/closing unit including a holding portion that holds the second member, and being configured to dispose the first member and the second member in contact with or away from each other, and a detector located above the first member and the second member, to detect that the liquid adheres to the surface region, when the first member and the second member are disposed away from each other.

According to still another aspect of the present invention, there is provided a plating apparatus having the inspection device, and a plating bath in which a substrate held by the substrate holder is plated.

DESCRIPTION OF EMBODIMENTS

Figure 1:
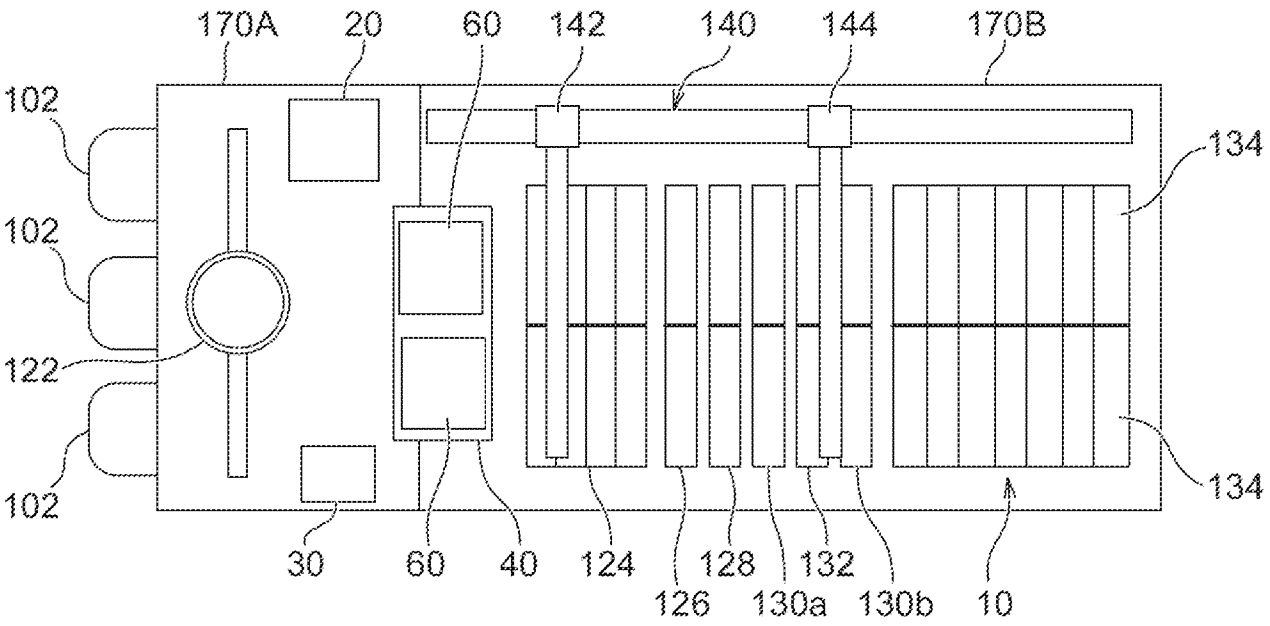
FIG. 1 is an overall layout of a plating apparatus according to the present embodiment.

Hereinafter, description will be made as to embodiments of the present invention with reference to the drawings. In the drawings described below, the same or corresponding components are denoted with the same reference signs, and redundant description is omitted. FIG. 1 is an overall layout of a plating apparatus according to the present embodiment. As shown in FIG. 1, this plating apparatus is roughly divided into a load/unload section 170A that loads a substrate onto a substrate holder 60 or unloads the substrate from the substrate holder 60, and a treatment section 170B that treats the substrate.

The load/unload section 170A is provided with three front-opening unified pods (FOUPs) 102, an aligner 30, and a spin rinse dryer 20. In each FOUP 102, a plurality of substrates such as semiconductor wafers are stored in multiple stages. The aligner 30 aligns, for example, an orientation flat or notch position of the substrate in a predetermined direction. The spin rinse dryer 20 rotates the plated substrate at a high speed and dries the substrate. In the vicinity of the spin rinse dryer 20, a fixing unit 40 (corresponding to one example of a substrate holder opening/closing unit) is provided on which the substrate holder 60 is mounted, to attach and detach the substrate. In a central region relative to these units 102, 30, 20 and 40, a substrate conveyor 122 including a conveying robot to convey the substrate among these units is disposed.

On the fixing unit 40, two substrate holders 60 can be mounted. In the fixing unit 40, the substrate is transferred between one of the substrate holders 60 and the substrate conveyor 122, and then the substrate is transferred between the other substrate holder 60 and the substrate conveyor 122. In the present embodiment, the fixing unit 40 has a function of an inspection device to inspect the substrate holder 60 as described later.

The treatment section 170B of the plating apparatus has a stocker 124, a pre-wet bath 126, a presoak bath 128, a first cleaning bath 130*a*, a blow bath 132, a second cleaning bath 130*b*, and a plating bath 10. In the stocker 124, the substrate holder 60 is stored and temporarily disposed. In the pre-wet bath 126, the substrate is soaked in pure water. In the presoak bath 128, an oxide film that is present on a surface of a conductive layer such as a seed layer formed on the surface of the substrate is etched and removed. In the first cleaning bath 130*a*, the presoaked substrate is cleaned together with the substrate holder 60 in a cleaning solution (the pure water or the like). In the blow bath 132, the cleaned substrate is drained. In the second cleaning bath 130*b*, the plated substrate is cleaned together with the substrate holder 60 in the cleaning solution. The stocker 124, the pre-wet bath 126, the presoak bath 128, the first cleaning bath 130*a*, the blow bath 132, the second cleaning bath 130*b*, and the plating bath 10 are arranged in this order.

The plating bath 10, for example, has a plurality of plating cells 134 provided with an overflow bath. In each plating cell 134, the substrate holder 60 holding the substrate is contained in a posture oriented in a vertical direction, and the substrate is immersed into a plating solution. A voltage is applied between the substrate and an anode in the plating cell 134, thereby plating the surface of the substrate with a copper plating solution or the like.

The plating apparatus has a substrate holder conveyor 140 that is located on a side of each unit, and the substrate holder 60 is conveyed together with the substrate between the respective units. In the conveyor, for example, a linear motor system is used. The substrate holder conveyor 140 has a first transporter 142 and a second transporter 144. The first transporter 142 conveys the substrate among the fixing unit 40, the stocker 124, the pre-wet bath 126, the presoak bath 128, the first cleaning bath 130*a*, and the blow bath 132. The second transporter 144 conveys the substrate among the first cleaning bath 130*a*, the second cleaning bath 130*b*, the blow bath 132, and the plating bath 10. Specifically, the first transporter 142 and the second transporter 144 convey the substrate holder 60 in a state where an in-plane direction of the held substrate is oriented in the vertical direction. In other words, the first transporter 142 and the second transporter 144 convey the substrate holder 60 holding the substrate and oriented in the vertical direction.

In another embodiment, a plating apparatus may include either one of a first transporter 142 and a second transporter 144. This transporter may convey a substrate among a fixing unit 40, a stocker 124, a pre-wet bath 126, a presoak bath 128, a first cleaning bath 130*a*, a second cleaning bath 130*b*, a blow bath 132, and a plating bath 10.

Figure 2:
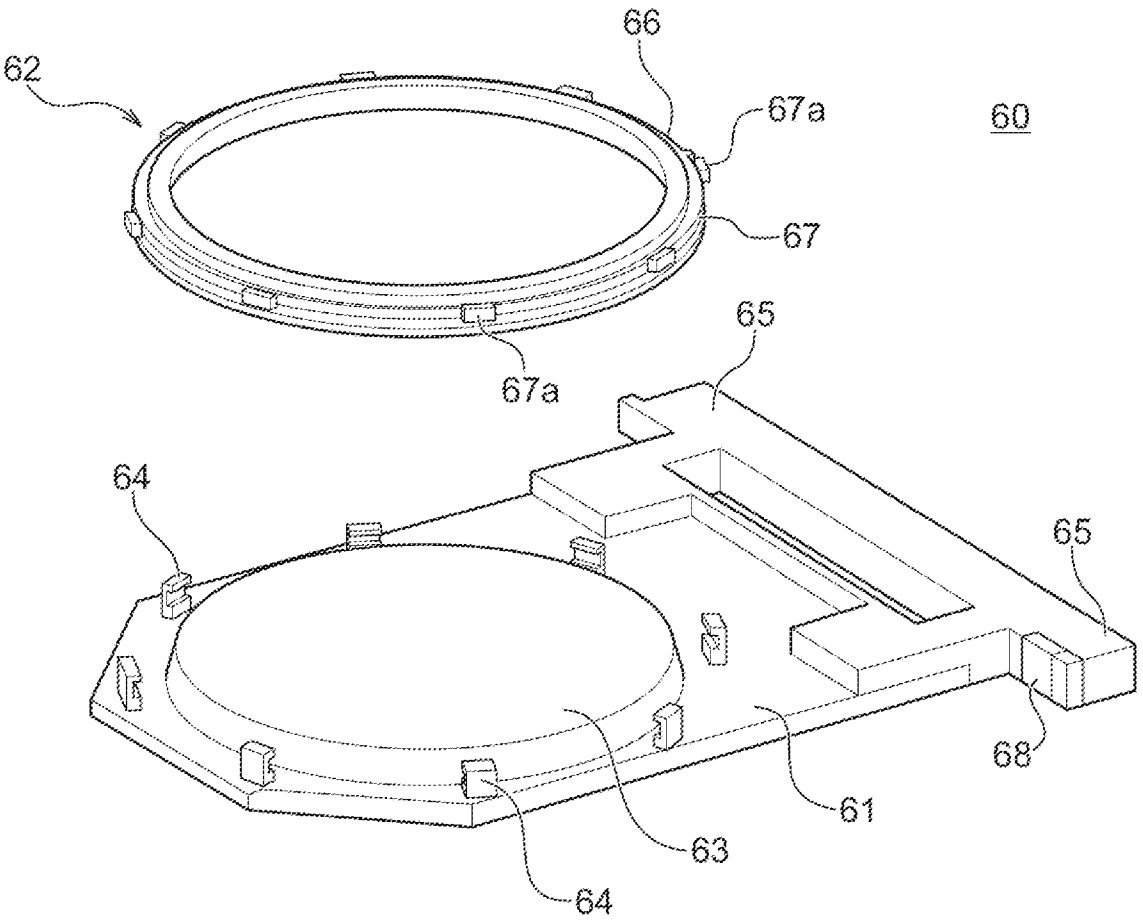
FIG. 2 is an exploded perspective view of a substrate holder.

Next, the substrate holder 60 and the fixing unit 40 shown in FIG. 1 will be described in detail. FIG. 2 is an exploded perspective view of the substrate holder 60. As shown in FIG. 2, the substrate holder 60 has, for example, a first holding member 61 (corresponding to one example of a first member) made of vinyl chloride and having a rectangular flat plate shape, and a second holding member 62 (corresponding to one example of a second member) configured to be attachable to and detachable from the first holding member 61. A mount surface 63 on which a substrate Wf is mounted is provided substantially in a central portion of the first holding member 61 of the substrate holder 60. Furthermore, a plurality of inverted L-shaped clampers 64 having inwardly protruding protrusions are provided at equal intervals along a periphery of the mount surface 63 on an outer side of the mount surface 63 of the first holding member 61.

A pair of substantially T-shaped hands 65 are coupled to an end of the first holding member 61 of the substrate holder 60, and the hands function as supporters in conveying, suspending and supporting the substrate holder 60. In the stocker 124 shown in FIG. 1, the hands 65 are caught on an upper surface of a peripheral wall of the stocker 124. Consequently, the substrate holder 60 is vertically suspended and supported. Furthermore, the hands 65 of the suspended and supported substrate holder 60 are gripped with the substrate holder conveyor 140, and the substrate holder 60 is conveyed.

Additionally, one of the hands 65 includes an external contact portion 68 electrically connected to an external power source. The external contact portion 68 is electrically connected to a plurality of relay contact portions (see FIG. 3) provided on an outer periphery of the mount surface 63 via a plurality of wires.

The second holding member 62 includes a ring-shaped seal holder 66. A press ring 67 is rotatably attached to the seal holder 66 of the second holding member 62, to press and fix the seal holder 66 onto the first holding member 61. Thus, the second holding member 62 is attached to the first holding member 61, so that the substrate Wf is sandwiched and held between the first holding member 61 and the second holding member 62. The press ring 67 has a plurality of ridges 67*a* that protrude outwardly in an outer peripheral portion of the press ring 67. An upper surface of each ridge 67*a* and a lower surface of the inward protrusion of the clamper 64 have tapered surfaces that tilt in opposite directions along a rotation direction.

To hold the substrate, first, in a state where the second holding member 62 is detached from the first holding member 61, the substrate Wf is mounted on the mount surface 63 of the first holding member 61, and the second holding member 62 is attached to the first holding member 61. Subsequently, the press ring 67 is rotated clockwise, so that the ridges 67*a* of the press ring 67 slip in (under) the inward protrusions of the clampers 64. Consequently, the first holding member 61 and the second holding member 62 are mutually clamped and locked via the tapered surfaces provided on the press ring 67 and the clampers 64, respectively, and the substrate Wf is held. To release the held substrate Wf, the press ring 67 is rotated counterclockwise in a state where the first holding member 61 and the second holding member 62 are locked. Consequently, the ridges 67*a* of the press ring 67 are disengaged from the inverted L-shaped clampers 64, thereby releasing the holding of the substrate Wf.

Figure 3:
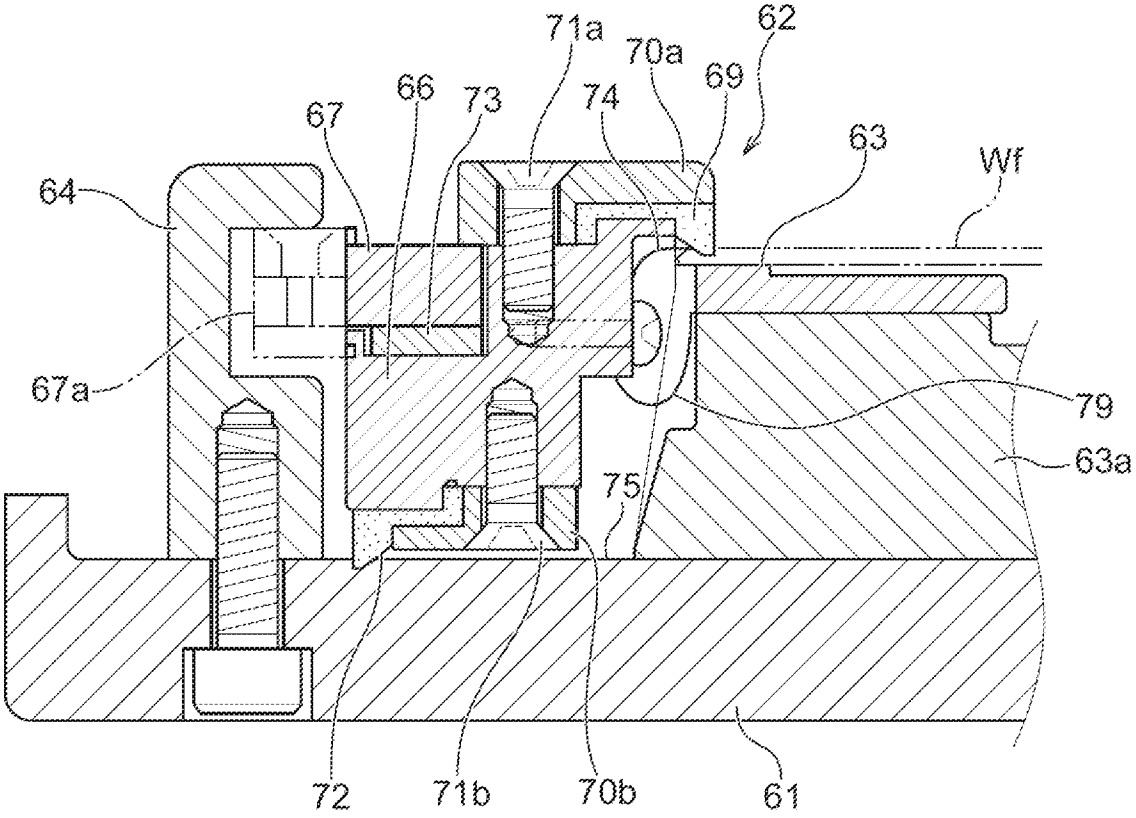
FIG. 3 is an enlarged partial cross-sectional view of the substrate holder.

FIG. 3 is an enlarged partial cross-sectional view of the substrate holder 60. As shown in FIG. 3, the second holding member 62 has a substrate-side seal member 69 (corresponding to one example of a seal member) and a first fixing ring 70*a* that fixes the substrate-side seal member 69 to the seal holder 66. The first fixing ring 70*a* is attached to the seal holder 66 via a fastener 71*a* such as a screw. Furthermore, the second holding member 62 has a holder-side seal member 72, and a second fixing ring 70*b* that fixes the holder-side seal member 72 to the seal holder 66. The second fixing ring 70*b* is attached to the seal holder 66 via a fastener 71*b* such as a screw.

A stepped portion is provided in an outer peripheral portion of the seal holder 66, and the press ring 67 is rotatably attached to this stepped portion via a spacer 73. The press ring 67 is attached so that the press ring cannot move outside due to the outer peripheral portion of the first fixing ring 70*a*.

As shown in FIG. 3, the second holding member 62 has an electric contact 74 that comes in contact with a peripheral edge of the surface of the substrate Wf to be treated, thereby causing a current to flow through the substrate Wf. A plurality of electric contacts 74 are provided along an inner periphery of the seal holder 66. The first holding member 61 also has a relay contact portion 79 that comes in contact with the electric contact 74 in a state where the second holding member 62 is attached to the first holding member 61, to supply the current from the external power source to the electric contact 74. A plurality of relay contact portions 79 are provided along the periphery of the mount surface 63. The relay contact portion 79 is conductive with the external contact portion 68. Consequently, the current supplied from the external power source is supplied to the surface of the substrate Wf via the external contact portion 68, the relay contact portion 79, and the electric contact 74.

When the second holding member 62 is locked with the first holding member 61, the substrate-side seal member 69 is pressed to come in contact with an outer peripheral portion of the surface of the substrate Wf. The substrate-side seal member 69 is uniformly pressed onto the substrate Wf. Consequently, a gap between the outer peripheral portion of the surface of the substrate Wf and the second holding member 62 is sealed, and the plating solution or the cleaning solution is prevented from coming in contact with the electric contacts 74. Similarly, when the second holding member 62 is locked with the first holding member 61, the holder-side seal member 72 is pressed to come in contact with the surface of the first holding member 61. The holder-side seal member 72 is uniformly pressed onto the first holding member 61. Consequently, a gap between the first holding member 61 and the second holding member 62 is sealed, and the plating solution or the cleaning solution is prevented from coming in contact with the electric contacts 74.

As shown in FIG. 3, a space where the plating solution or the cleaning solution is prevented from intruding into the gap between the first holding member 61 and the second holding member 62 (hereinafter referred to as an intrusion preventive space in the present description) is formed by the substrate-side seal member 69 and the holder-side seal member 72. Furthermore, in the first holding member 61, a surface region where the intrusion of the plating solution or the cleaning solution is prevented is formed by the substrate-side seal member 69 and the holder-side seal member 72. This surface region where the intrusion of the plating solution or the cleaning solution is prevented refers to an arbitrary surface region of the first holding member 61 that defines the intrusion preventive space, for example, a surface 75 shown in FIG. 3. The surface 75 is located around the mount surface 63. In other words, the surface region is disposed along a periphery of the substrate Wf held by the substrate holder 60. Furthermore, the mount surface 63 of the substrate Wf is located on an upper surface of a substantially disc-shaped pedestal 63*a*. The surface 75 is disposed at a position lower than a position of the mount surface 63. Note that in the present embodiment, the substrate holder 60 oriented in the vertical direction is contained in the plating bath 10, and the whole second holding member 62 is immersed into the plating solution or the cleaning solution. Consequently, the substrate-side seal member 69 and the holder-side seal member 72 are required to define the intrusion preventive space. However, as described later, only a part of the second holding member 62 is immersed into the plating solution or the cleaning solution as in a substrate holder 60 (see FIG. 8) for use in a so-called cup type of plating apparatus in which a substrate placed in a horizontal state is plated. In this case, an intrusion preventive space can be defined only by a substrate-side seal member 69.

Figure 4:
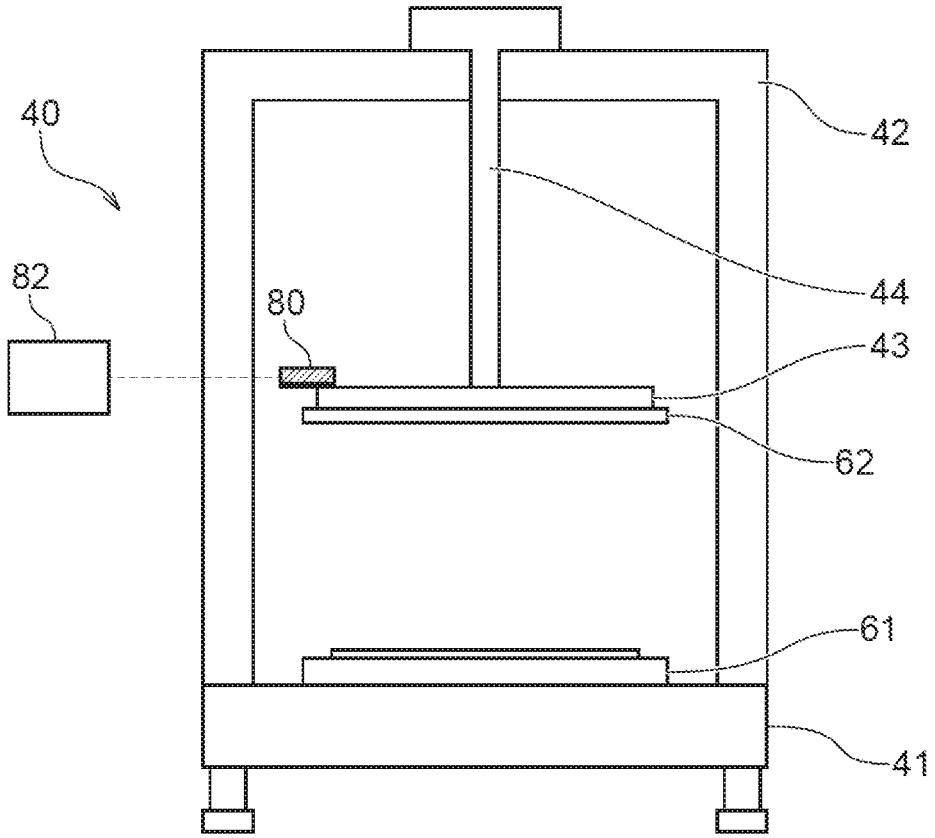
FIG. 4 is a schematic side view of a fixing unit.
Figure 5:
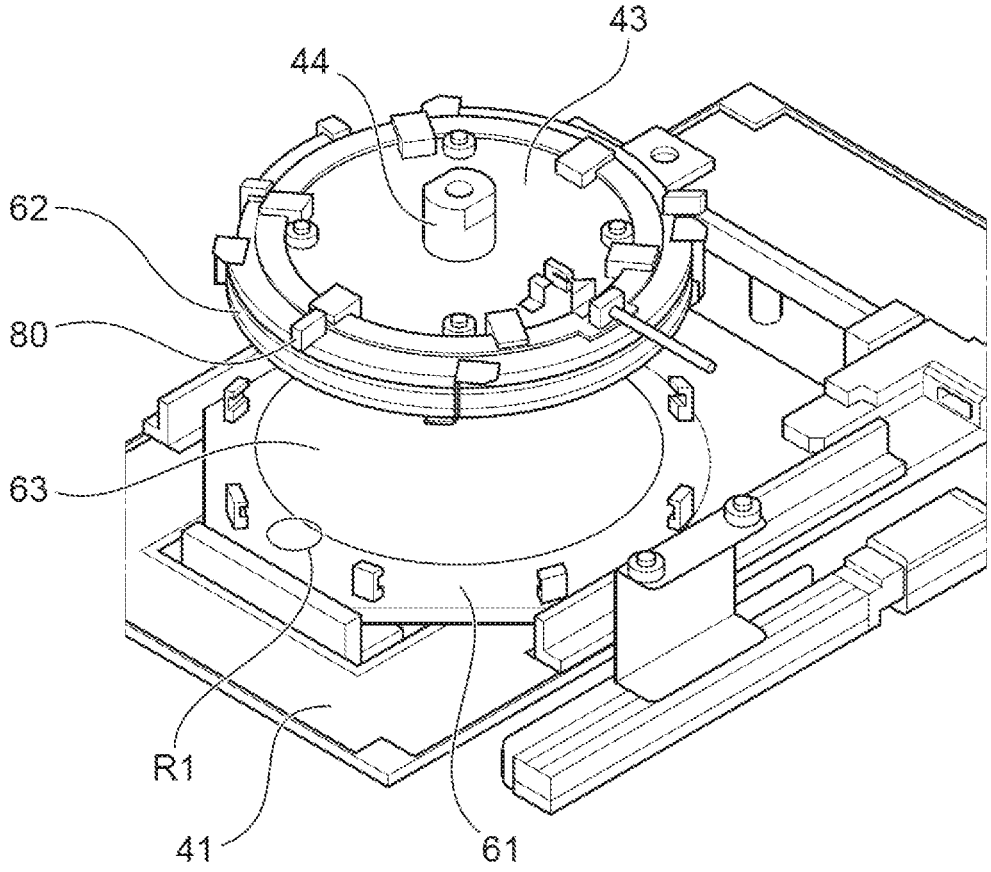
FIG. 5 is a partially enlarged perspective view of the fixing unit.

Next, a configuration of the fixing unit 40 shown in FIG. 2 will be described. FIG. 4 is a schematic side view of the fixing unit 40. FIG. 5 is a partially enlarged perspective view of the fixing unit 40. The fixing unit 40 is a device to open and close the substrate holder 60. In other words, the fixing unit 40 disposes the first holding member 61 and the second holding member 62 in contact with or away from each other. The fixing unit 40 has a pedestal 41 on which the first holding member 61 is mounted, a frame 42, a holding plate 43 that holds the second holding member 62 and attaches and detaches the second holding member to and from the first holding member 61, and an actuator 44 that moves the holding plate 43 in the vertical direction. The actuator 44 is fixed to the frame 42, and not only moves the holding plate 43 in the vertical direction but also rotates the plate in a peripheral direction.

The substrate holder 60 conveyed to the fixing unit 40 by the substrate holder conveyor 140 shown in FIG. 1 is horizontally mounted on the pedestal 41 so that the in-plane direction of the held substrate is oriented in a horizontal direction. The actuator 44 lowers the holding plate 43, so that the holding plate 43 holds the second holding member 62. The actuator 44 rotates, in the peripheral direction, the holding plate 43 that holds the second holding member 62, to release the locking of the second holding member 62 and the first holding member 61. Afterward, the actuator 44 maintains the holding plate 43 in a state where the second holding member 62 is detached as shown in FIG. 4 and FIG. 5.

The substrate-side seal member 69 or the holder-side seal member 72 of the substrate holder 60 shown in FIG. 3 may break, dirt may adhere to these members, or the substrate holder 60 itself may be distorted. When an abnormality is generated in the substrate holder 60 in this way, there is concern that a liquid such as the plating solution or the cleaning solution intrudes into the intrusion preventive space described above with reference to FIG. 2 and FIG. 3. Therefore, when the liquid intrudes into the intrusion preventive space and when the second holding member 62 is detached from the first holding member 61 as shown in FIG. 4 and FIG. 5, the liquid adheres to the surface region of the first holding member 61 where the intrusion of the liquid is prevented, for example, the surface 75 shown in FIG. 3.

In the present embodiment, the inspection device includes a detector to detect whether or not the liquid adheres to the above surface region of the first holding member 61. Specifically, in the present embodiment, this detector has an image sensor 80 configured to acquire image data of a predetermined region in the above surface region of the first holding member 61. For example, the image sensor 80 is attached to the holding plate 43 as shown in FIG. 4 and FIG. 5, and configured to photograph the first holding member 61 located below the holding plate 43. The present invention is not limited to this example, and the image sensor 80 can be provided at an arbitrary position where the above surface region of the first holding member 61 can be photographed. It is preferable that the image sensor 80 is located above the first holding member 61 and the second holding member 62 as shown in FIG. 4 and FIG. 5. In this case, the image sensor 80 can photograph not only the first holding member 61 but also the second holding member 62. Consequently, it can be detected whether or not the liquid adheres to an arbitrary location of the second holding member 62.

Furthermore, in the present embodiment, the substrate holder 60 oriented in the vertical direction is conveyed to the fixing unit 40 by the substrate holder conveyor 140 shown in FIG. 1. Consequently, the liquid that has intruded in the intrusion preventive space moves toward a lowermost portion in the vertical direction and accumulates in the lowermost portion of the intrusion preventive space due to gravity, while the substrate holder 60 is conveyed. To solve the problem, in the present embodiment, the image sensor 80 acquires image data of a region R1 (see FIG. 5) including the lowermost portion of the above surface region of the first holding member 61 in the vertical direction, in a state where the substrate holder 60 is oriented in the vertical direction. Consequently, even when the liquid intrudes from the arbitrary location into the intrusion preventive space, the intrusion of the liquid can be detected only by acquiring the image data of the lowermost portion of the intrusion preventive space with the single image sensor 80. Note that the present invention is not limited to this example. For example, when the substrate holder 60 oriented in the horizontal direction is conveyed to the fixing unit 40, the image sensor 80 may be configured to photograph an arbitrary region of the above surface region. A plurality of image sensors 80 may photograph a plurality of regions, or the plurality of regions may be photographed while moving the single image sensor 80.

As shown in FIG. 4, the fixing unit 40 includes a controller 82 connected to the image sensor 80 in communication with the image sensor 80. For example, the controller 82 has a computer readable recording medium in which a predetermined program and the like are stored, a central processing unit (CPU) that executes the program of the recording medium, and the like, so that an operation of the image sensor 80 can be controlled. The controller 82 stores the image data of the region R1 to which any liquid does not adhere, in the recording medium in advance.

Figure 6:
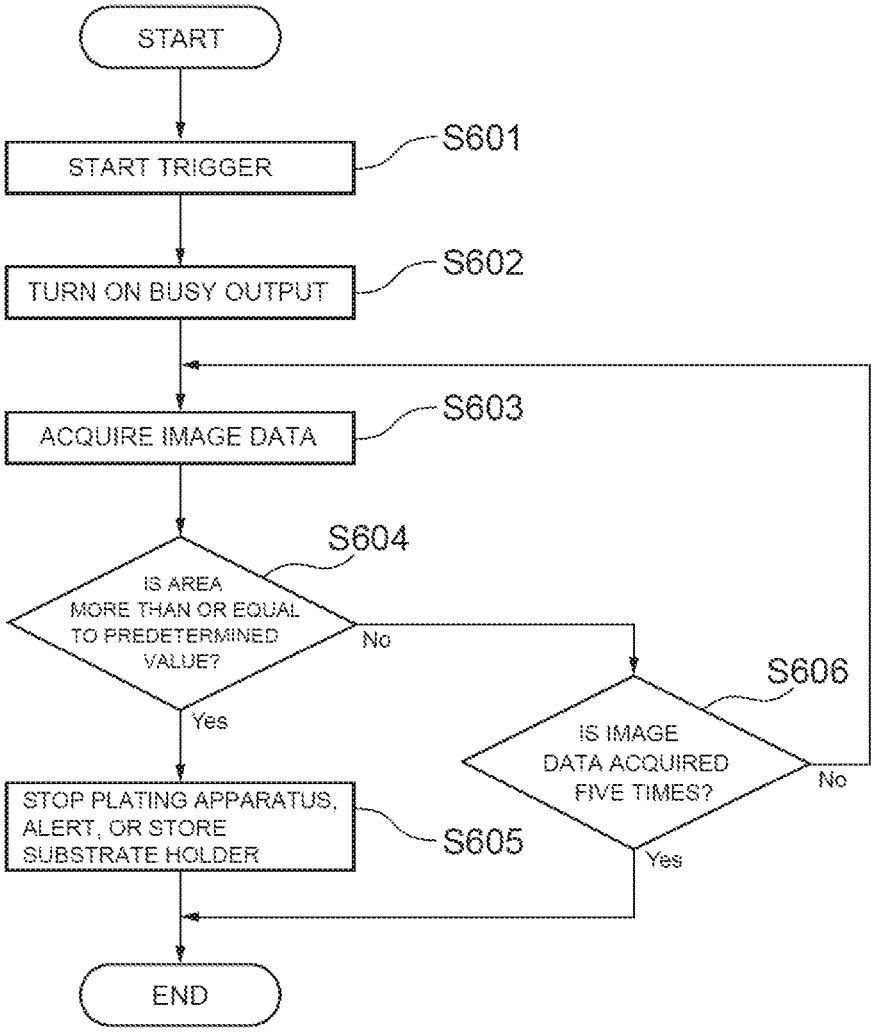
FIG. 6 is a flowchart showing an inspection method of the substrate holder in the fixing unit.

Next, an inspection method of the substrate holder 60 in the fixing unit 40 will be described. FIG. 6 is a flowchart showing the inspection method of the substrate holder 60 in the fixing unit 40. First, the controller 82 receives a start trigger immediately after the second holding member 62 is removed from the first holding member 61 with the holding plate 43 of the fixing unit 40 (step S601), to turn on a busy output of the image sensor 80 (step S602). Note that here, the start trigger may be drive of an arbitrary portion that constitutes the plating apparatus, for example, movement of the substrate conveyor 122 or the drive of the holding plate 43 of the fixing unit 40.

Subsequently, the image sensor 80 acquires the image data of the region R1 of the first holding member 61 in response to an instruction from the controller 82 (step S603). The acquired image data of the region R1 is transmitted to the controller 82. As described above, the controller 82 records the image data of the region R1 to which any liquid does not adhere, in the recording medium in advance. Then, the controller 82 compares the region R1 to which any liquid does not adhere with image data of the region R1 which is acquired by the image sensor 80. More specifically, the controller 82 compares a color of the region R1 to which any liquid does not adhere (e.g., a numeric value in a gray scale image) with a color of the image data of the region R1 which is acquired by the image sensor 80 (e.g., a numeric value in a gray scale image).

Figure 7A:
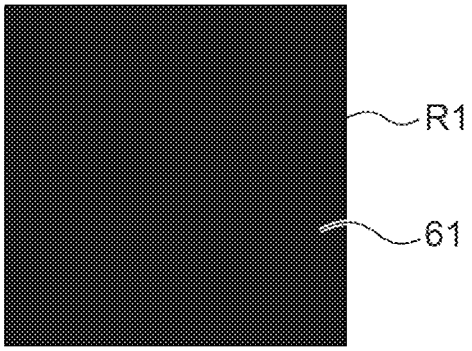
FIG. 7A is a view showing one example of image data of a region to which a liquid does not adhere.
Figure 7B:
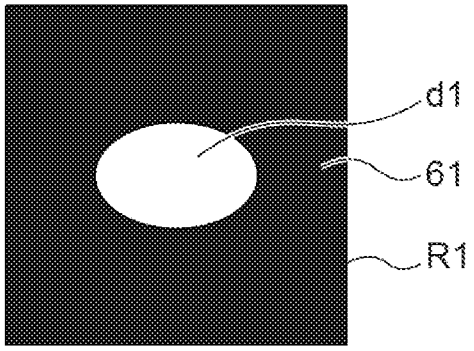
FIG. 7B is a view showing one example of image data of a region acquired by an image sensor.

FIG. 7A is a view showing one example of the image data of the region R1 to which any liquid does not adhere. FIG. 7B is a view showing one example of the image data of the region R1 which is acquired by the image sensor 80. As shown in FIG. 7A, a color of the first holding member 61 can be uniformly displayed in the region R1 to which any liquid does not adhere. On the other hand, as shown in FIG. 7B, a liquid drop d1 of the plating solution or the cleaning solution is displayed in the region R1 acquired by the image sensor 80. Consequently, in the region R1 shown in FIG. 7B, a color of a portion in which the liquid drop d1 is present can be a color of the liquid drop d1 itself, or is different from a color of another portion of the first holding member 61 due to refraction of light passed through the liquid drop d1. The controller 82 compares the image data shown in FIG. 7A with the image data shown in FIG. 7B, and calculates an area of the color of the region R1 of FIG. 7B which is different from the color of the region R1 of FIG. 7A. That is, the controller 82 calculates an area where it is presumed that the liquid drop d1 is present. Subsequently, the controller 82 judges whether the calculated area is more than or equal to a predetermined value (step S604). Note that this predetermined value is beforehand set in the recording medium of the controller 82. When the predetermined value is smaller, a smaller amount of liquid can be detected.

When it is judged that the calculated area is more than or equal to the predetermined value (the step S604, Yes), the controller 82 judges that the liquid drop adheres to the region R1 of the first holding member 61, and can transmit a stop signal to the plating apparatus (step S605). Alternatively, the controller 82 may generate an alert such as sound, light or vibration via an unshown informing device in place of or together with the transmission of the stop signal (the step S605). Consequently, it can be informed to a manager of the plating apparatus that the abnormality is generated in the substrate holder 60. Alternatively, in place of or together with these operations, the controller may control the substrate holder conveyor 140 so that the substrate holder 60 assumed as an inspection target is automatically stored in the stocker 124, and is not used in a subsequent new plating process of the substrate (to stop the use of the substrate holder 60 in which the abnormality is generated).

On the other hand, when it is judged that the calculated area is less than the predetermined value (the step S604, No), the controller 82 judges whether or not the image data of the region R1 is acquired a predetermined number of times (step S606). In the present embodiment, as one example, the controller 82 judges whether or not the image data of the region R1 is acquired five times.

When the controller 82 judges that the image data of the region R1 is not acquired five times (the step S606, No), the controller returns to the step S603 in which the image sensor 80 acquires the image data of the region R1 again (the step S603). When the controller 82 judges that the image data of the region R1 is acquired five times (the step S606, Yes), the operation of the plating apparatus is continued. That is, in this case, it is judged that the calculated area is less than the predetermined value in all the image data of the region R1 acquired the predetermined number of times, and it is therefore judged that any abnormality is not generated in the substrate holder 60. As the number of the times to acquire the image data in the step S606, a numeric value of 1 or more can be set in the controller 82 in advance. In a case where the predetermined number of the times is plural, possibility of wrong detection of the liquid drop d1 can be decreased as compared with a case where the set number of the times is 1.

Note that, for example, as to the image data of the region R1 which is acquired at the fourth time, when it is judged that the calculated area is more than or equal to the predetermined value (the step S604, Yes), the controller advances to the step S605. That is, although the set number of the times to acquire the image data is 5, the image data is not acquired at the fifth time, and the fourth time to acquire the image data is the last time. Therefore, when the number of the times to acquire the image data is set to be plural and when it is detected in at least one of a plurality of pieces of image data that the liquid adheres to the region R1, the controller advances to the step S605.

When an area where it is presumed that the liquid drop d1 is present is calculated in association with the step S604, the liquid drop d1 cannot be accurately photographed due to light reflection depending on a shape of the liquid drop d1 by the image sensor 80. Consequently, when it is judged that the image data of the region R1 is not acquired as much as the predetermined number of the times (the step S606, No), a gas may be blown toward the region R1 of the first holding member 61 by an unshown blow unit before the image data is acquired in the step S603. Alternatively, the first holding member 61 may be vibrated by an unshown vibration unit. Consequently, when the liquid drop d1 is present in the region R1, the shape of the liquid drop d1 can be changed, and it is possible to increase possibilities that the liquid drop d1 can be accurately photographed when the image data is acquired at and after the second time.

In the flowchart shown in FIG. 6, the area where it is presumed that the liquid drop d1 is present is calculated in the step S604. However, the present invention is not limited to this example, and the controller 82 may compare the image data shown in FIG. 7A with the image data shown in FIG. 7B, and may calculate an area of the same color of the region R1 of FIG. 7B as the color of the region R1 of FIG. 7A. In other words, the controller 82 may calculate a match ratio between the image data shown in FIG. 7A and the image data shown in FIG. 7B. Consequently, the controller 82 calculates an area where the liquid drop d1 is not present. In this case, the controller 82 can judge whether the calculated area (i.e., the area where it is presumed that the liquid drop d1 is not present) is less than or equal to the predetermined value (the step S604). In this example, when the predetermined value is larger, the smaller amount of liquid can be detected.

As described above, the fixing unit 40 according to the present embodiment can detect that the liquid adheres to the region R1 where the intrusion of the liquid is prevented by the substrate-side seal member 69. It is also considered that the image sensor 80 does not photograph the liquid, and photographs the substrate-side seal member 69, to detect breakage or dirt on the substrate-side seal member 69. However, even when the substrate-side seal member 69 is slightly broken, any liquid does not necessarily intrude into the intrusion preventive space. Furthermore, even when the breakage or the dirt is not found in the substrate-side seal member 69 as a result of the photographing of the substrate-side seal member 69, the slight amount of liquid may intrude into the intrusion preventive space. On the other hand, in the present embodiment, it is possible to directly detect that the liquid adheres to the region R1, and hence, even the small amount of liquid can be detected with high probability.

Furthermore, according to the present embodiment, the image data of the region R1 which is acquired by the image sensor 80 is compared with the image data of the region R1 to which any liquid does not adhere, to detect the adhesion of the liquid. That is, according to the present embodiment, the image sensor 80 directly photographs the liquid adhered to the first holding member 61, and it is detected based on the photographed image data whether or not the liquid is present. Therefore, even the small amount of liquid can be detected with the high probability.

According to the present embodiment, the color of the image data of the region R1 which is acquired by the image sensor 80 is compared with the color of the region R1 to which any liquid does not adhere. When the area of the different color is more than or equal to the predetermined value, or when the area of the same color is less than or equal to the predetermined value, it is judged that the liquid adheres. When a desired numeric value is set as this predetermined value, an amount of the liquid permitted to intrude into the intrusion preventive space can be arbitrarily set.

In the above, the embodiment of the present invention has been described, but the above described embodiment of the present invention is for easy understanding of the present invention, and does not restrict the present invention. Needless to say, the present invention can be changed or modified without departing from the gist of the invention, and the present invention includes equivalents. Furthermore, it is possible to arbitrarily combine or omit the respective components described in the claims and specification, in a range where at least a part of the above described problem can be solved or a range where at least a part of the effect can be produced.

Figure 8:
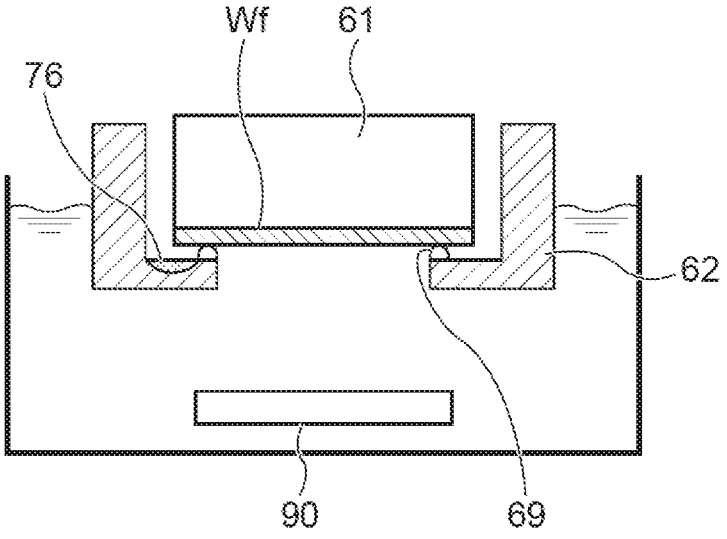
FIG. 8 is a schematic view of a substrate holder for use in a cup type of plating apparatus.

In the present embodiment, it is explained that the substrate holder 60 oriented in the vertical direction and contained in the plating bath 10 is inspected, but the present invention is not limited to this example, and the substrate holder 60 for use in such a so-called cup type of plating apparatus as shown in FIG. 8 may be inspected. The substrate holder 60 shown in FIG. 8 has a first holding member 61 and a second holding member 62. The first holding member 61 and the second holding member 62 can come in contact with and away from each other, and a substrate is sandwiched between the first holding member 61 and the second holding member 62. The second holding member 62 has the substrate-side seal member 69 that seals a surface of a substrate Wf. Consequently, as shown in FIG. 8, a surface region 76 where a plating solution or a cleaning solution is prevented from intruding is formed in the second holding member 62. When the substrate Wf held by the substrate holder 60 is plated, as shown in the drawing, the first holding member 61 is located above, and the second holding member 62 is located below. The substrate Wf and the second holding member 62 are arranged to face an anode 90 so that only the substrate and the member come in contact with the plating solution or the cleaning solution. When the intrusion of the liquid is detected in the substrate holder 60, the surface region 76 of the second holding member 62 can be photographed with the image sensor 80 in a state where the first holding member 61 and the second holding member 62 are disposed away from each other. The image sensor 80 can be installed with an arbitrary configuration to photograph the surface region 76 of the second holding member 62. However, the image sensor 80 may be provided integrally with the first holding member 61, or may be attached to a holding portion (not shown) that holds the first holding member 61 so that the first holding member 61 and the second holding member 62 are disposed away from each other.

Furthermore, in the present embodiment, the image sensor 80 to detect the liquid that intrudes into the intrusion preventive space is used, but the present invention is not limited to this example. For example, a photoelectric sensor may be used in place of the image sensor 80. When the photoelectric sensor is used, the photoelectric sensor can be disposed at a position similar to a position of the image sensor 80, i.e., the holding plate 43 or the like. When the first holding member 61 is detached from the second holding member 62, the photoelectric sensor can irradiate the region R1 with light and detect whether or not the liquid is present.

It is explained above that it is judged by the controller 82 provided in the fixing unit 40 whether or not the liquid drop d1 adheres to the region R1 of the first holding member 61. However, the present invention is not limited to this example, and a controller that controls the whole plating apparatus may perform the judgment. Alternatively, an unshown computer connected to the plating apparatus by wire or wirelessly may receive a signal from the image sensor 80 and perform the judgment based on this signal. The judgment may be performed with one computer connected to a plurality of plating apparatuses. Alternatively, processing may be performed with a computer installed inside or outside a plant via the Internet. Alternatively, artificial intelligence may be configured to learn a large number of images in which any liquid drop does not adhere and a large number of images in which the liquid drop adheres, and the artificial intelligence may perform the judgment.

Hereinafter, several aspects to be disclosed herein will be described.

According to a first aspect, there is provided an inspection method of a substrate holder for holding a substrate holder. This inspection method has a step of providing a substrate holder comprising a first member and a second member between which a substrate is held, an electric contact configured to come in contact with a surface of the substrate to be treated, and a seal member configured to come in contact with the surface of the substrate to be treated so that a liquid does not come in contact with the electric contact, the first member having a surface region where intrusion of the liquid is prevented by the seal member, the second member having the seal member, a step of holding the second member by a holding portion of a substrate holder opening/closing unit, and disposing the first member and the second member away from each other, and a detection step of detecting that the liquid adheres to the surface region of the first member, by a detector located above the first member and the second member, when the first member and the second member are disposed away from each other.

According to a second aspect, in the inspection method of the first aspect, the detection step includes a step of acquiring image data of a predetermined region in the surface region of the first member, and a comparison step of comparing the predetermined region to which any liquid does not adhere with the image data.

According to a third aspect, in the inspection method of the second aspect, the comparison step includes a step of comparing a color of the predetermined region to which any liquid does not adhere with a color of the image data of the predetermined region.

According to a fourth aspect, in the inspection method of the third aspect, the comparison step has a step of calculating an area of a color of the image data of the predetermined region which is different from the color of the predetermined region to which any liquid does not adhere, or an area of the same color as the color of the predetermined region to which any liquid does not adhere, and a step of judging whether the area of the different color is more than or equal to a predetermined value or whether the area of the same color is less than or equal to the predetermined value.

According to a fifth aspect, in the inspection method of the second aspect to the fourth aspect, the detection step includes a step of acquiring the image data of the predetermined region a plurality of times, the inspection method further including a step of issuing an alert, stopping a plating apparatus, or controlling the plating apparatus to stop use of the substrate holder, when it is detected in at least one of a plurality of pieces of image data that the liquid adheres to the surface region.

According to a sixth aspect, in the inspection method of the first aspect to the fifth aspect, the substrate holder oriented in a vertical direction is conveyed to the substrate holder opening/closing unit, the surface region is disposed along a periphery of the substrate held by the substrate holder, and the detection step includes detecting whether or not the liquid adheres to a region including a lowermost portion of the surface region of the first member in the vertical direction, in a state where the substrate holder is oriented in the vertical direction.

According to a seventh aspect, in the inspection method of the first aspect to the sixth aspect, the step of disposing the first member and the second member away from each other includes a step of disposing the first member and the second member away from each other in a state where the substrate holder is oriented in a horizontal direction.

According to an eighth aspect, there is provided an inspection device of a substrate holder. This inspection device has a substrate holder opening/closing unit for open or close a substrate holder comprising a first member and a second member between which a substrate is held, an electric contact configured to come in contact with a surface of the substrate to be treated, a seal member configured to come in contact with the surface of the substrate to be treated so that a liquid does not come in contact with the electric contact, and a surface region where intrusion of the liquid is prevented by the seal member, the second member having the seal member, the substrate holder opening/closing unit including a holding portion that holds the second member, and being configured to dispose the first member and the second member in contact with or away from each other, and a detector located above the first member and the second member, to detect that the liquid adheres to the surface region, when the first member and the second member are disposed away from each other.

According to a ninth aspect, in the inspection device of the eighth aspect, the detector includes an image sensor and a controller, the image sensor acquires image data of a predetermined region in the surface region of the first member, and the controller compares the predetermined region to which any liquid does not adhere with the image data.

According to a tenth aspect, in the inspection device of the ninth aspect, the controller compares a color of the predetermined region to which any liquid does not adhere with a color of the image data of the predetermined region.

According to an eleventh aspect, in the inspection device of the tenth aspect, the controller calculates an area of a color of the image data of the predetermined region which is different from the color of the predetermined region to which any liquid does not adhere, or an area of the same color as the color of the predetermined region to which any liquid does not adhere, and the controller judges that the liquid adheres to the surface region of the first member, when the area of the different color is more than or equal to a predetermined value or when the area of the same color is less than or equal to the predetermined value.

According to a twelfth aspect, in the inspection device of any one of the ninth aspect to the eleventh aspect, the image sensor acquires the image data of the predetermined region a plurality of times, and the controller issues an alert, stops a plating apparatus, or controls the plating apparatus to stop use of the substrate holder, when it is detected in at least one of a plurality of pieces of image data that the liquid adheres to the surface region.

According to a thirteenth aspect, in the inspection device of any one of the eighth aspect to the twelfth aspect, the substrate holder oriented in a vertical direction is conveyed to the substrate holder opening/closing unit, the surface region is disposed along a periphery of the substrate held by the substrate holder, and the detector detects that the liquid adheres to a region including a lowermost portion of the surface region of the first member in the vertical direction, in a state where the substrate holder is oriented in the vertical direction.

According to a fourteenth aspect, in the inspection device of any one of the eighth aspect to the thirteenth aspect, the substrate holder opening/closing unit detaches the second member from the first member in a state where the substrate holder is oriented in a horizontal direction.

According to a fifteenth aspect, there is provided a plating apparatus having the inspection device according to any one of the eighth aspect to the fourteenth aspect, and a plating bath in which a substrate held by the substrate holder is plated.

REFERENCE SIGNS LIST

40 . . . fixing unit
60 . . . substrate holder
61 . . . first holding member
62 . . . second holding member
69 . . . substrate-side seal member
75 . . . surface
80 . . . image sensor
82 . . . controller

What is claimed is:

1. An inspection method of a substrate holder for holding a substrate, comprising:

a step of providing the substrate holder comprising a first member and a second member between which a substrate is held, an electric contact configured to come in contact with a surface to be treated of the substrate, and a seal member configured to come in contact with the surface to be treated of the substrate so that a liquid does not come in contact with the electric contact, the first member having a surface region where intrusion of the liquid is prevented by the seal member, the second member having the seal member and the electric contact, a step of holding the second member by a holding portion of a substrate holder opening/closing unit, and disposing the first member and the second member away from each other, and a detection step of detecting that the liquid adheres to the surface region of the first member, by an image sensor located above the first member and the second member, when the first member and the second member are disposed away from each other.

2. The inspection method according to claim 1, wherein the detection step comprises:

a step of acquiring image data of a predetermined region in the surface region of the first member, and a comparison step of comparing the predetermined region to which any liquid does not adhere with the image data.

3. The inspection method according to claim 2, wherein the comparison step includes a step of comparing a color of the predetermined region to which any liquid does not adhere with a color of the image data of the predetermined region.

4. The inspection method according to claim 3, wherein the comparison step has:

a step of calculating an area of a color of the image data of the predetermined region which is different from the color of the predetermined region to which any liquid does not adhere, or an area of the same color as the color of the predetermined region to which any liquid does not adhere, and a step of judging whether the area of the different color is more than or equal to a predetermined value or whether the area of the same color is less than or equal to the predetermined value.

5. The inspection method according to claim 2, wherein the detection step includes a step of acquiring the image data of the predetermined region a plurality of times, the inspection method further comprising a step of issuing an alert, stopping a plating apparatus, or controlling the plating apparatus to stop use of the substrate holder, when it is detected in at least one of a plurality of pieces of image data that the liquid adheres to the surface region.

6. The inspection method according to claim 1, wherein the substrate holder oriented in a vertical direction is conveyed to the substrate holder opening/closing unit, the surface region is disposed along a periphery of the substrate held by the substrate holder, and the detection step includes detecting whether or not the liquid adheres to a region including a lowermost portion of the surface region of the first member in the vertical direction, in a state where the substrate holder is oriented in the vertical direction.

7. The inspection method according to claim 1, wherein the step of disposing the first member and the second member away from each other includes a step of disposing the first member and the second member away from each other in a state where the substrate holder is oriented in a horizontal direction.

8. An inspection device of a substrate holder comprising:

a substrate holder opening/closing unit configured to open or close a substrate holder comprising a first member and a second member between which a substrate is held, an electric contact configured to come in contact with a surface of the substrate to be treated, a seal member configured to come in contact with the surface of the substrate to be treated so that a liquid does not come in contact with the electric contact, and a surface region where intrusion of the liquid is prevented by the seal member, the second member having the seal member, the substrate holder opening/closing unit including a holding portion that holds the second member, and being configured to dispose the first member and the second member in contact with or away from each other, and an image sensor located above the first member and the second member, to detect that the liquid adheres to the surface region, when the first member and the second member are disposed away from each other.

9. The inspection device according to claim 8, the inspection device further comprises a controller, wherein the image sensor acquires image data of a predetermined region in the surface region of the first member, and the controller compares the predetermined region to which any liquid does not adhere with the image data.

10. The inspection device according to claim 9, wherein the controller compares a color of the predetermined region to which any liquid does not adhere with a color of the image data of the predetermined region.

11. The inspection device according to claim 10, wherein the controller calculates an area of a color of the image data of the predetermined region which is different from the color of the predetermined region to which any liquid does not adhere, or an area of the same color as the color of the predetermined region to which any liquid does not adhere, and the controller judges that the liquid adheres to the surface region of the first member, when the area of the different color is more than or equal to a predetermined value or when the area of the same color is less than or equal to the predetermined value.

12. The inspection device according to claim 9, wherein the image sensor acquires the image data of the predetermined region a plurality of times, and the controller issues an alert, stops a plating apparatus, or controls the plating apparatus to stop use of the substrate holder, when it is detected in at least one of a plurality of pieces of image data that the liquid adheres to the surface region.

13. The inspection device according to claim 8, wherein the substrate holder oriented in a vertical direction is conveyed to the substrate holder opening/closing unit, and the surface region is disposed along a periphery of the substrate held by the substrate holder, and the detector detects that the liquid adheres to a legion including a lowermost portion of the surface region of the first member in the vertical direction, in a state where the substrate holder is oriented in the vertical direction.

14. The inspection device according to claim 8, wherein the substrate holder opening/closing unit detaches the second member from the first member in a state where the substrate holder is oriented in a horizontal direction.

15. A plating apparatus comprising:

the inspection device according to claim 8, and a plating bath in which a substrate held by the substrate holder is plated.

* * * * *